US007337643B2

(12) United States Patent
Weiermair et al.

(10) Patent No.: US 7,337,643 B2
(45) Date of Patent: Mar. 4, 2008

(54) ROLLING MILL DRIVE WITH A COUPLING AND DECOUPLING DEVICE

(75) Inventors: Johannes Weiermair, Altmünster (AT); Guenter Mittermayr, St. Florian (AT)

(73) Assignee: Voest-Alpine Industrieanlagenbau GmbH & Co. (AT)

( * ) Notice: Subject to any disclaimer, the term of this patent is extended or adjusted under 35 U.S.C. 154(b) by 64 days.

(21) Appl. No.: 10/573,605

(22) PCT Filed: Aug. 31, 2004

(86) PCT No.: PCT/EP2004/009679

§ 371 (c)(1),
(2), (4) Date: Apr. 26, 2006

(87) PCT Pub. No.: WO2005/039791

PCT Pub. Date: May 6, 2005

(65) Prior Publication Data

US 2007/0271984 A1 Nov. 29, 2007

(30) Foreign Application Priority Data

Sep. 29, 2003 (AT) ..... A 1539/2003

(51) Int. Cl.
*F16D 1/10* (2006.01)
*B21B 35/14* (2006.01)

(52) U.S. Cl. ..... 72/249; 72/237; 72/238; 72/239; 464/182; 464/901

(58) Field of Classification Search ..... 72/237, 72/238, 239, 249; 464/169, 182, 905, 901
See application file for complete search history.

(56) References Cited

U.S. PATENT DOCUMENTS 2,420,573 A * 5/1947 Stewart, Sr. ..... 464/110
2,618,941 A * 11/1952 Iversen ..... 464/7
2,697,335 A 12/1954 Peterson
3,126,722 A * 3/1964 Kramer et al. ..... 464/16

(Continued)

FOREIGN PATENT DOCUMENTS

DE 4035941 5/1992

(Continued)

OTHER PUBLICATIONS

International Search Report PCT/EP2004/009679 dated Nov. 19, 2004.

*Primary Examiner*—Dmitry Suhol
(74) *Attorney, Agent, or Firm*—Ostrolenk, Faber, Gerb & Soffen, LLP

(57) ABSTRACT

A rolling mill drive with at least one drive spindle arranged between a drive unit and a driven roll and terminating in a spindle head connected detachably to the neck of the roll. A coupling and decoupling device is arranged between the neck of the roll and the spindle head of the drive spindle. The coupling and decoupling device includes a coupling sleeve, a coupling pin inserted releasably into the coupling sleeve, and a locking element which is displaceable transversely to the axis of rotation of the neck of the roll. The locking element is inserted into the coupling sleeve and engages behind the coupling pin in an operating position of the locking element. The locking element is capable of being coupled to a displacing device for displacing it.

14 Claims, 5 Drawing Sheets

U.S. PATENT DOCUMENTS

| | | | | | |
|---|---|---|---|---|---|
| 3,327,497 | A | * | 6/1967 | Amend et al. | 464/158 |
| 3,628,366 | A | * | 12/1971 | Leitner | 72/249 |
| 3,673,816 | A | * | 7/1972 | Kuazaj | 464/169 |
| 3,779,037 | A | * | 12/1973 | Petros et al. | 464/184 |
| 3,926,532 | A | | 12/1975 | Schlenker et al. | |
| 4,094,179 | A | * | 6/1978 | Okuda | 72/238 |
| 4,136,533 | A | * | 1/1979 | Okuda | 464/182 |
| 4,305,678 | A | * | 12/1981 | Majoor | 403/361 |
| 4,362,412 | A | * | 12/1982 | Kunz | 403/11 |
| 4,392,759 | A | | 7/1983 | Cook | |
| 5,000,024 | A | | 3/1991 | Seidl et al. | |

FOREIGN PATENT DOCUMENTS

| | | |
|---|---|---|
| DE | 195 08 526 | 9/1996 |
| DE | 101 58 711 A1 | 6/2003 |
| EP | 0 728 538 A1 | 8/1996 |
| GB | 2 288 003 A | 10/1995 |

* cited by examiner

ROLLING MILL DRIVE WITH A COUPLING AND DECOUPLING DEVICE

CROSS REFERENCE TO RELATED APPLICATION

The present application is a 35 U.S.C. §§ 371 national phase conversion of PCT/EP2004/009679, filed 31 Aug. 2004, which claims priority of Austrian Application No. AT 1539/2003, filed 29 Sep. 2003. The PCT International Application was published in the German language.

BACKGROUND OF THE INVENTION

The invention relates to a rolling mill drive with drive spindles, which are arranged between drive units and driven rolls and which terminate in spindle heads. One spindle head in each case is connected detachably to the neck of a roll, in particular of a working roll. A coupling and decoupling device is arranged between the neck of the roll and the spindle head of the drive spindle.

The working rolls used in roll stands are driven by electric motors either directly or via supporting or intermediate rolls. The transmission of the drive torque to the height-adjustable rolls takes place via drive spindles in order to compensate for the angular displacements caused by different rolling strip thicknesses. The drive spindles can be formed by articulated shafts or toothed spindles and make length compensation possible in the axial direction. Pinion gearings or twin drive gearings are usually additionally interposed between the drive motors and the drive spindles. During day-to-day rolling operation, the working rolls are subjected to great mechanical stresses and, on account of constant rolling program change, they also have to be exchanged frequently. This requires a coupling and decoupling device appropriate to these great stresses between the neck of the driven roll and the drive spindle transmitting the drive torque. A number of such releasable connecting elements are already known but do not adequately meet the requirements with regard to mechanical loadability and short coupling and decoupling times with high operational reliability and a low maintenance requirement.

A possible embodiment of a coupling and decoupling device used on rolling mill drives is a ring bayonet closure such as is illustrated and described in EP-B 0 324 978 or DE-A 40 35 941. In both cases, the bayonet closure consists of a closure pin and an externally toothed closure wheel which can be rotated relative to the closure pin and can be positioned in such a way in relation to the closure pin by an adjusting device likewise comprising a toothing that the teeth on the closure pin and on the closure wheel which lie opposite one another in an operating position are staggered in a release position and separation of the components is thus possible. The high production outlay for the toothings and the exacting requirements for the production tolerances of all the components are disadvantages of these constructions. Furthermore, very accurate positioning of the driven working roll, the drive spindle and the spindle mounting in relation to one another is necessary in order to ensure distortion-free interaction of the components. On the other hand, the production tolerances necessary on the heavy components can lead to jamming of the bayonet during mounting work.

A locking device for a releasable connection between a drive spindle and a roll neck in a rolling mill is likewise already known from DE-C 44 10 306 and DE-A 195 08 526. In this case, when the shaft journal is introduced into a coupling sleeve, a spring-loaded locking bar engages automatically in a recess of the shaft journal and forms a play-free connection. The locking bar engages in this recess at an angle of 45° to 55° to the shaft axis and makes the opposed decoupling operation possible when a movement counter to the coupling direction takes place along inclined guide surfaces. A radially displaceable securing bolt, which is held in a locking position under spring loading, prevents automatic decoupling of the connection. The securing bolt can be displaced into release position by intervention from outside, for which a separate opening tool is necessary, after which the pulling-off movement of the driven rolls initiates separation from the articulated shaft. A major disadvantage of this solution is that two locking devices offset by 180° in relation to one another have to be arranged in order to avoid unbalance in the drive system, or special balancing is necessary. In addition, this solution consists of many individual parts and therefore involves high production outlay.

Releasable couplings with radially displaceable locking bolts for positionally fixed connection of a sleeve on a shaft are known from U.S. Pat. No. 4,392,759 and U.S. Pat. No. 3,926,532 for example. According to U.S. Pat. No. 4,392,759, locking bolts arranged radially in a sleeve engage counter to spring force in an annular groove of a splined shaft and in this way secure the connection between shaft and sleeve. The locking bolts are held in this locking position by a locking sleeve which is displaceable axially counter to a spring force. As this is a simple manually operated device with a rotating/sliding sleeve for comparatively small loads, this device is not suitable for problem-free use in rolling mills. Furthermore, adequate security against unintentional opening is lacking. An embodiment of a coupling which is largely similar is disclosed in U.S. Pat. No. 3,926,532, in which the locking sleeve can be brought into a release position by a rotary movement in the peripheral direction counter to spring force.

SUMMARY OF THE INVENTION

It is therefore an object of the present invention to propose a rolling mill drive with a coupling and decoupling device which is distinguished by simple construction of the individual components in terms of production and by their ease of mounting with high operational reliability and a low maintenance requirement.

According to the invention, this object is achieved by a coupling and decoupling device. It includes a coupling sleeve, a coupling pin inserted releasably into the coupling sleeve and a locking element which is arranged displaceably transversely to the axis of rotation of the neck of the roll. The locking element is inserted into the coupling sleeve and engages behind the coupling pin in an operating position of the locking element. The locking element is designed to be capable of being coupled to a displacing device. The design of the locking element as a component which can be displaced from outside in the radial direction between a fixed operating position and an opened mounting position makes possible simple construction of this locking element and of the bores necessary for insertion of the locking element into the coupling sleeve in terms of production and also problem-free, canting-free and largely tolerance-insensitive release of the heavy components when roll change takes place.

In a development of the invention, the coupling pin comprises a foot plate for end-side fastening to the neck of the roll and a coupling hook with at least one locking surface which projects from this foot plate. A longitudinal groove with at least one counter-locking surface is milled into the locking element. For guiding the coupling hook in and out, the longitudinal groove has a coupling opening at one location. For releasing and connecting the locking element, the coupling and decoupling device be brought by means of the displacing device into a release position in which the coupling opening in the locking element is aligned with the coupling hook. The locking element can be brought into an operating position in which the locking surface on the coupling hook lies opposite the counter-locking surface on the locking element.

According to a preferred embodiment, the coupling hook is of T-shaped design and the locking element has a longitudinal groove of T-shaped design. However, it is alternatively also possible to design the head piece of the locking hook with a cylindrical shape, for example, and accordingly to equip the locking element with a cross-sectionally cylindrical longitudinal groove. In the end, it is not the concrete cross-sectional shape which is important but the complementary completion of the components with interacting supporting surfaces.

A favorable arrangement of the components is brought about if the axis of rotation of the neck of the roll, the axis of rotation of the coupling pin, the axis of rotation of the coupling sleeve and of the spindle head are arranged in alignment with one another and the longitudinal axis of the locking element is oriented transversely to this axis of rotation and intersects it. This development too is distinguished by simple production.

The locking element has a circular cylindrical outer contour and is inserted in a rotationally secured manner into a circular cylindrical bore, preferably a blind hole bore, aligned radially in the coupling sleeve.

For automatic fixing of the operating position and in order reliably to avoid unintentional opening of this locking, a preloaded tension spring is installed between the locking element and a fixed stop on the coupling sleeve.

A receiver for a displacing device is arranged on at least one side of the locking element. For this purpose, the outwardly extending pin of the locking element is equipped with a supporting surface on which the counter-supporting surface of a displacing device which can be pressed on as required can be supported. The displacing device comprises a pressure medium cylinder, preferably a standard hydraulic cylinder.

For performing roll change in the roll stand, it is necessary before decoupling to support the articulated spindle in its position in the region of the coupling sleeve. In order for it to be possible to perform the supporting operation and the immediately following unlocking operation in as short a period of time as possible, the coupling sleeve has a peripheral annular groove. At least one supporting surface of a spindle support lies opposite this annular groove and this at least one supporting surface is designed to be capable of being brought into engagement with the annular groove in a way supporting the coupling sleeve. In addition, the displacing device for the locking element is connected to the locking element to ensure synchronous movement of the displacing device and of the supporting surface of the spindle support.

This synchronous movement can be achieved on the one hand by virtue of the fact that the displacing device is fastened rigidly to the displaceable spindle support and on the other hand by virtue of the fact that the displacing device and the supporting surfaces of the spindle support are connected to a control, preferably a synchronizing control, for synchronizing their movement sequence.

Further advantages and features of the invention emerge from the description below of non-limiting illustrative embodiments, reference being made to the accompanying figures, in which

DESCRIPTION OF A PREFERRED EMBODIMENT

Figure 1:
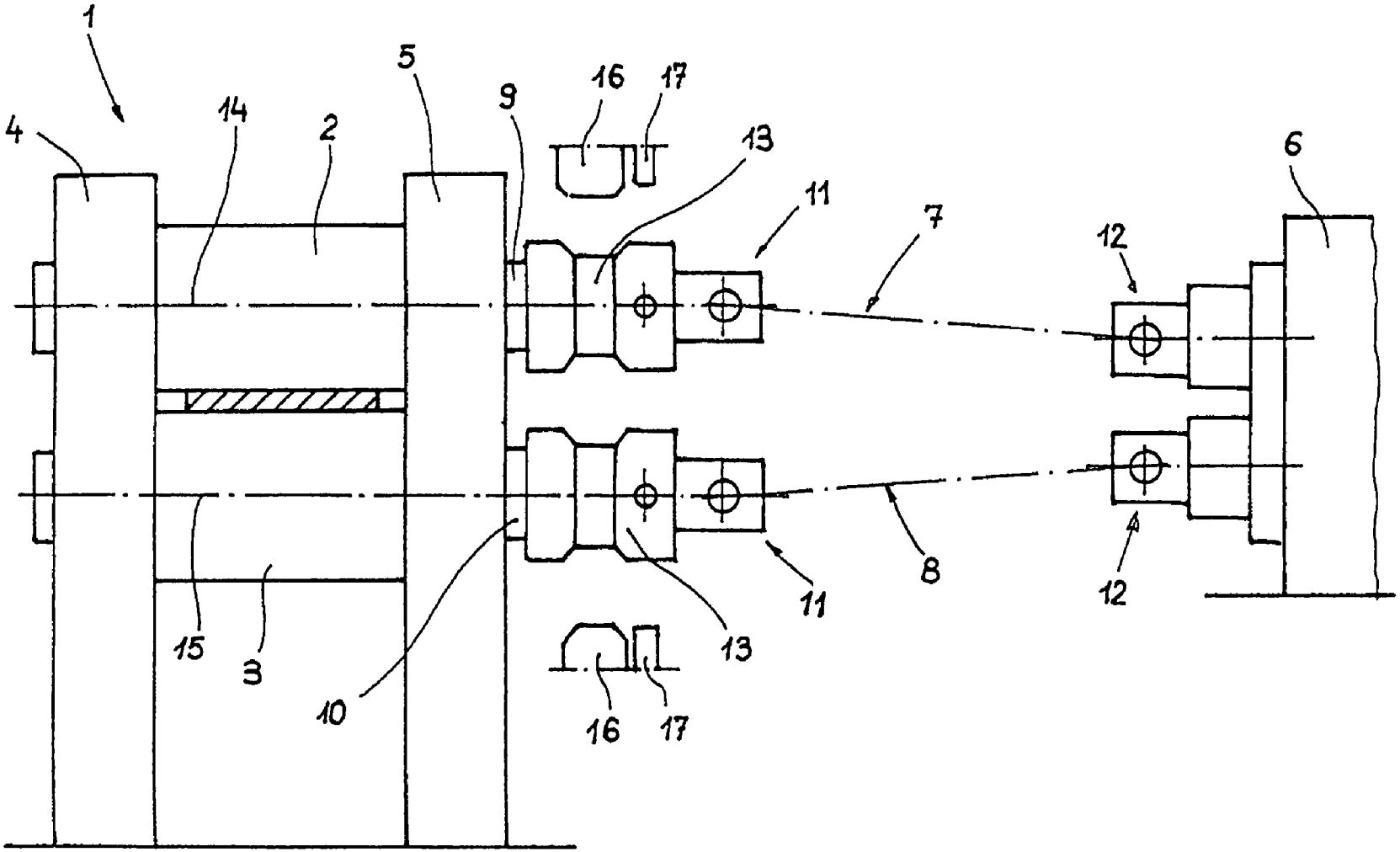
FIG. 1 shows a diagrammatic illustration of a rolling mill drive with motors, drive spindles and roll stand.

FIG. 1 shows a diagrammatic illustration of a two-high roll stand 1 with two driven rolls 2, 3, which are used as working rolls in the illustrative embodiment described and at least one roll of which, usually the upper roll 2, is supported height-adjustably in the stand uprights 4, 5 for adaptation to different rolling stock thicknesses. Electric motors, from which the drive torque is transmitted to the necks 9, 10 of the rolls via drive spindles 7, 8 designed as articulated shafts or toothed spindles, are provided as drive units 6. The drive spindles 7, 8 are of telescopic design and take up axial changes in length, which result on the one hand from the different vertical position of the upper roll 2 and on the other hand owing to the displacement of the working rolls during rolling in the axial direction. The drive spindles 7, 8 terminate on both sides in spindle heads 11, 12, which allow different inclined positions of the articulated shafts on account of the vertical adjustment of the rolls and displacements of the working rolls in the axial direction.

A roll change requires rapid mechanized decoupling of the rolls 2, 3 from the drive unit 6. This is brought about by a coupling and decoupling device 13, which connects the neck 9, 10 of a roll to the spindle head 11 of a drive spindle 7, 8 in an easily detachable way. Before roll change, which takes place on the operating side in the direction of the roll axis of rotation, 14, 15, the drive spindles 7, 8 and the associated coupling and decoupling device 13 are supported in their operating position by means of a spindle support 16, which can be moved in, and held in alignment with the roll axis of rotation 14, 15. At the same time, a displacing device 17 for actuating the coupling and decoupling device 13 is displaced into an operating position, and then the release position necessary for the decoupling operation is set by actuating the displaying device 17 and the rolls 2, 3 are removed from the roll stand 1 with the aid of a roll change carriage (not illustrated). In the same way, after a new roll set consisting essentially of the two rolls and the associated installation parts has been introduced into the stand uprights 4, 5, the coupling and decoupling device 17 is brought into the locked position and the displacing device 13 and the spindle support 16 are moved back into a retracted position which allows roll operation.

Figure 2:
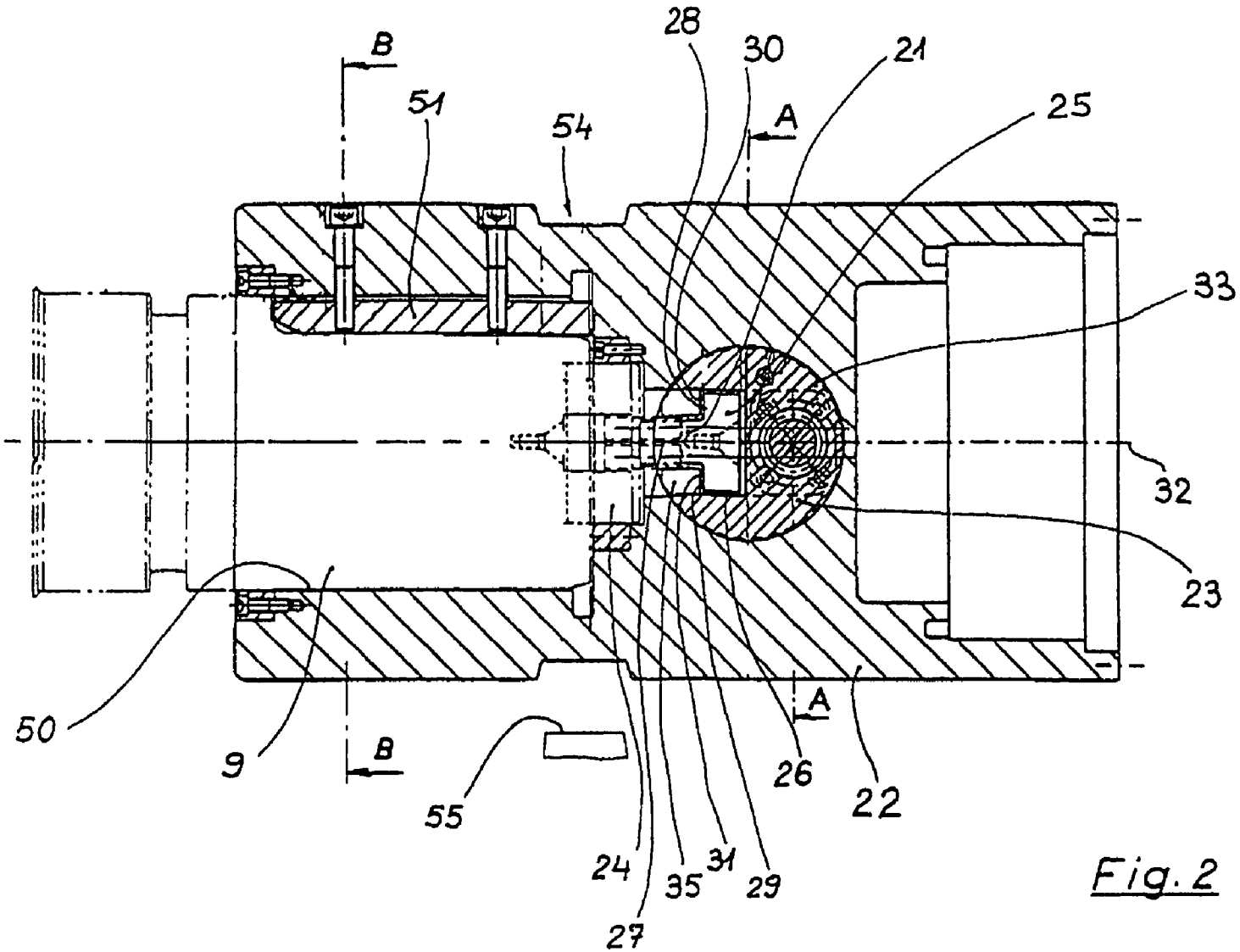
FIG. 2 shows a longitudinal section through a coupling and decoupling device according to the invention.

The rapidly releasable coupling and decoupling device 13 is illustrated in detail in a longitudinal section in FIG. 2. It consists essentially of a coupling pin 21, a coupling sleeve 22 and a locking element 23. The coupling pin 21 is connected coaxially to the neck 9 of the roll 2, 3 and comprises a foot plate 24 via which it is screwed to the neck 9 on the end side. A coupling hook 25 of T-shaped design, which is enclosed in a T-shaped longitudinal groove 26 of a displaceable locking element 23, projects from the foot plate 24. The coupling pin 21 forms on the coupling hook 25, in a normal plane in relation to its longitudinal axis 27, two locking surfaces 28, 29, opposite which counter-locking surfaces 30, 31 in the T-shaped longitudinal groove 26 of the locking element 23 lie in the locked position of the coupling and decoupling device 13. The locking element 23, which is of cylindrical design in its outer contour, is in the coupling sleeve 22 inserted at right angles to the axis of rotation 32 of the coupling sleeve into a blind hole bore 33, the longitudinal axis 34 of the locking element 23 intersecting the axis of rotation of the coupling sleeve. The locking element 23 is arranged longitudinally displaceably in the blind hole bore 33 and can be brought from a constantly automatically locked operating position into an unlocked release position by the displacing device 17. A T-shaped longitudinal groove 26 for receiving the T-shaped coupling hook 25 is milled in the locking element 23 parallel to its longitudinal axis 34, that portion 35 of the locking element 23 engaging behind the coupling hook having in the release position and corresponding to the longitudinal extent 36 of the locking surface 28 a coupling opening 37 in order for it to be possible to perform the coupling and decoupling operation, that is for it to be possible to insert the coupling hook 25 into the T-shaped longitudinal groove 26 of the locking element 23.

Figure 3B:
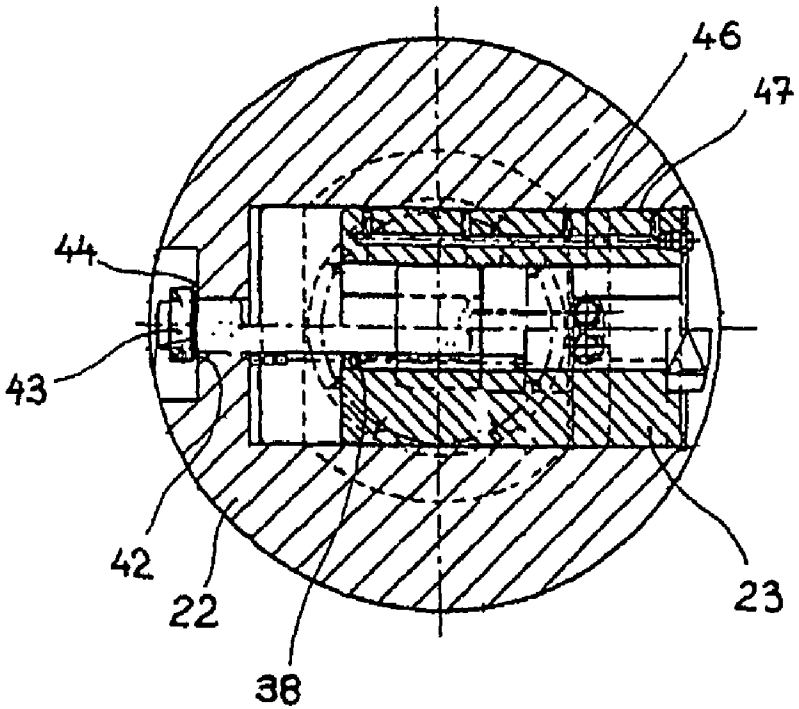
FIG. 3*b* shows the coupling and decoupling device in the locked position of the locking element in a section along the line A-A in FIG. 2.
Figure 3A:
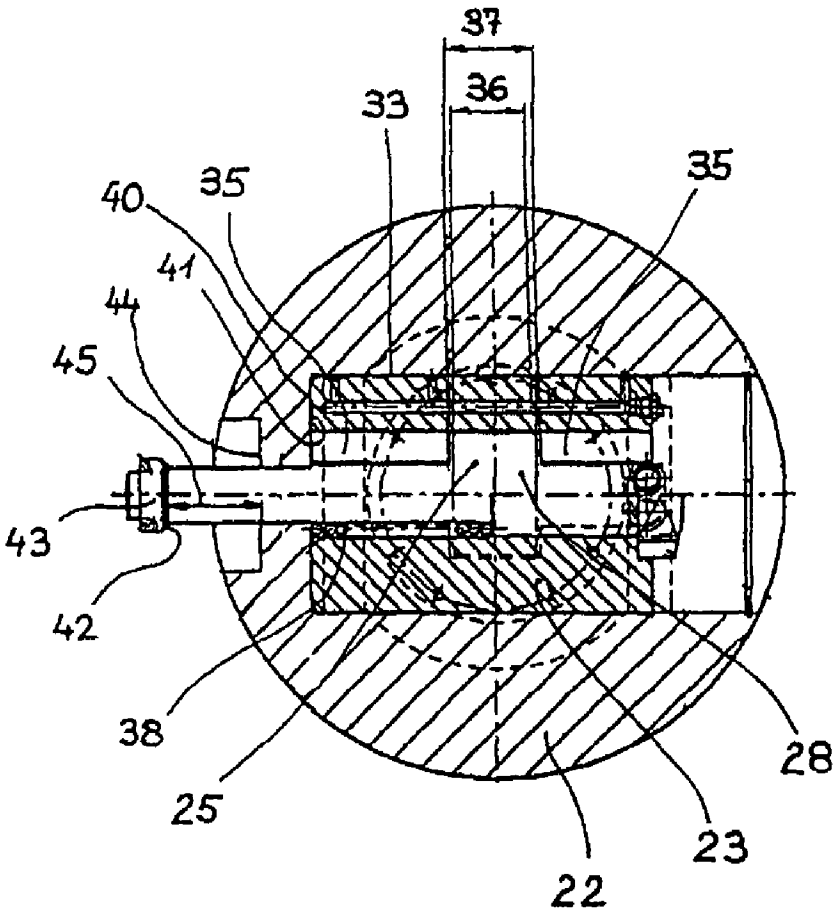
FIG. 3*a* shows the coupling and decoupling device in the opened position of the locking element in a section along the line A-A in FIG. 2.

The unlocked release position is illustrated in greater detail in FIG. 3*a* and the locked operating position is illustrated in greater detail in FIG. 3*b*.

Figure 5:
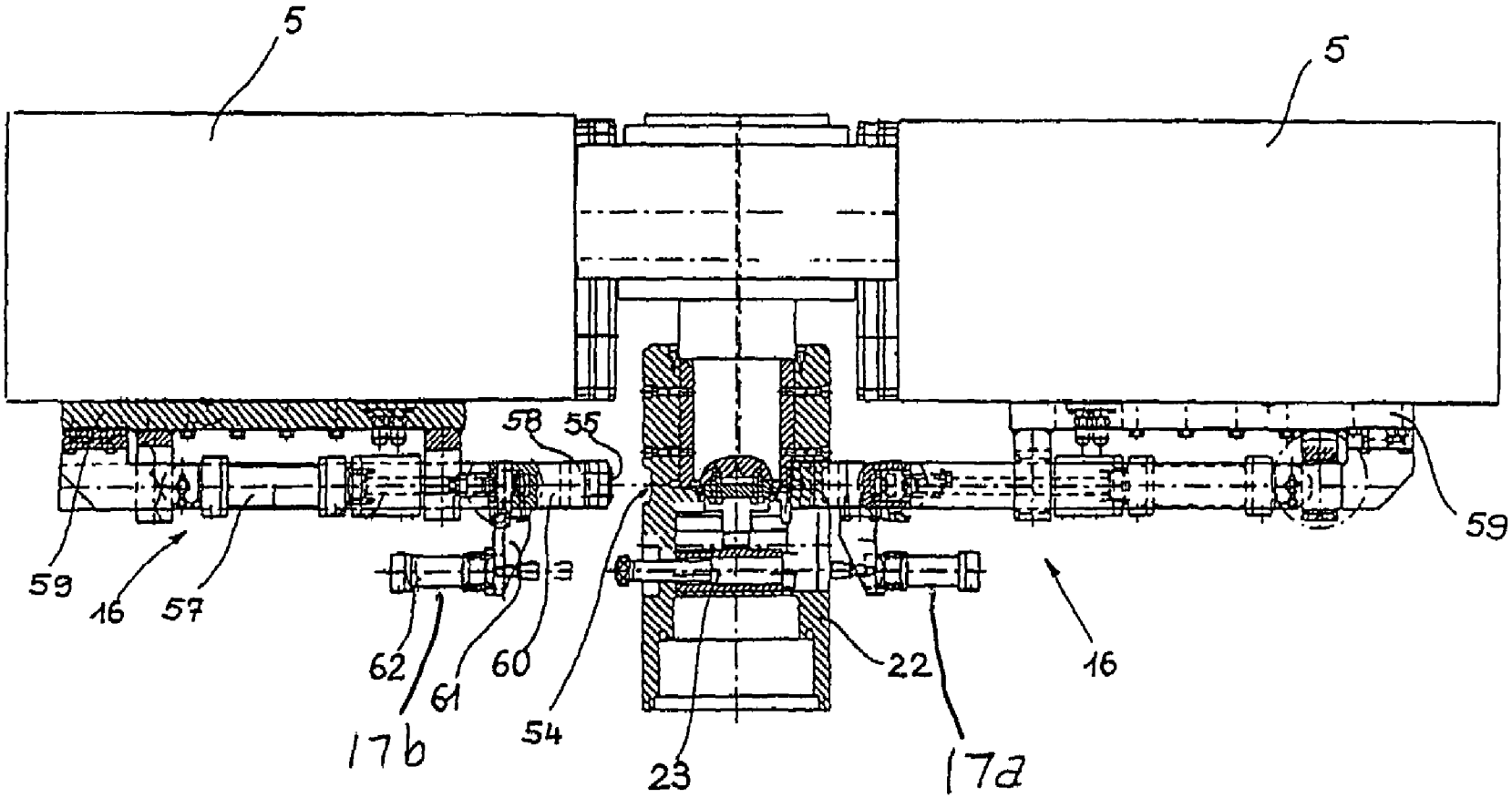
FIG. 5 shows a diagrammatic top view of the coupling and decoupling device with the spindle supports.

In FIG. 3*a*, the locking element 23 has been brought into the release position, in which the coupling hook 25 lies opposite the coupling opening 37 in the T-shaped longitudinal groove 26 of the locking element 23 and thus affords the coupling hook 25 access to the T-shaped longitudinal groove 26, by the displacing device 17*a* illustrated in FIG. 5 counter to spring force (arrow direction) exerted by a tension spring 38. The release position is fixed by the end side 40 of the displaced locking element 23 bearing against the bottom surface 41 of the blind hole bore 33 in the coupling sleeve 22. Here, the bottom surface 41 acts as a position-defining stop.

The locked operating position illustrated in FIG. 3*b* is brought about by the locking element 23 being moved by means of the displacing device 17*b* illustrated in FIG. 5 in the direction of action of the spring force (arrow direction) until the supporting surface 42 of the supporting ring 43 bears against the counter-supporting surface 44 of the coupling sleeve 22. This takes place either by releasing the spring force or by the displacing device 17 itself if the spring force is not sufficient for return. After the displacing device 17 has been detached from the locking element 23 and the latter has been moved back into the operating position, the locking element remains secured in this operating position under the effect of the preloading force of the tension spring 38. In addition, preferably automatic locking of the coupling and decoupling device 13 is thus ensured without actuation of the displacing device 17. The displacement travel 45 between release position and operating position corresponds to at least the longitudinal extent of the locking surface 36 in order to ensure full support of the locking surface of the coupling hook 25 on the counter-locking surface 30, 31 of the T-shaped longitudinal groove 26.

Lubricant lines 46, through which lubricant can be conveyed to the contact surface 47 between locking element 23 and coupling sleeve 22, are arranged in the locking element 23. This ensures at all times reliable return of the locking element 23 into the stationary operating position.

Figure 4:
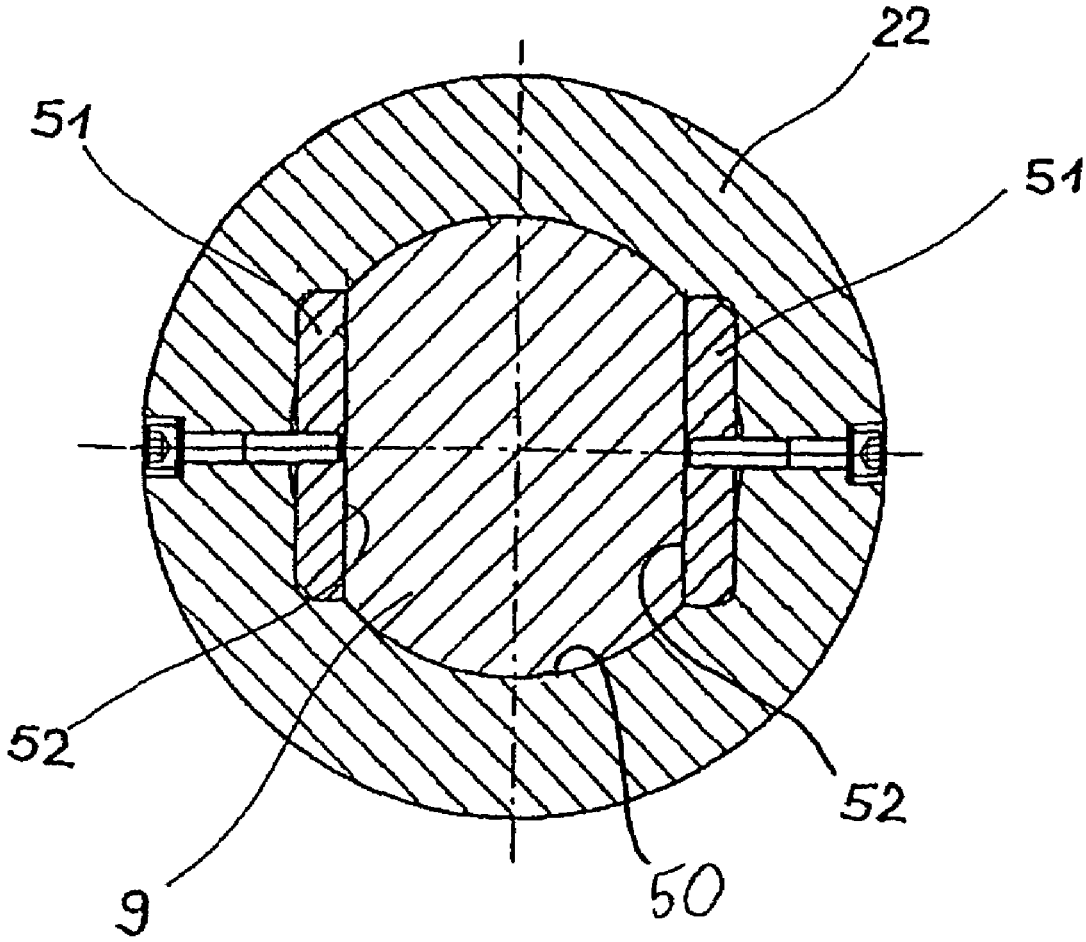
FIG. 4 shows a cross section through the coupling sleeve along the line B-B in FIG. 2.

The coupling sleeve 22 has to transmit the drive torque from the drive unit 6 to the neck of the roll. For this purpose, guide strips 51, the supporting surfaces 52 of which interact positively with flattened portions on the neck 9, screwed together with the coupling sleeve are inserted into the wall of the receiving bore 50 in a rotationally fixed manner in a longitudinal portion of the coupling sleeve 22 in which the coupling sleeve surrounds the neck 9 (FIG. 4). At the same time, these supporting surfaces 52 make it possible to center the coupling hook 25 in relation to the locking element 23 with regard to the rotational angular position of these components in relation to one another when the coupling hook is threaded into the T-shaped longitudinal groove 26. In order to ensure alignment of the roll axis of rotation 14 and the coupling sleeve 22 during roll change, a peripheral annular groove 54, in which a number of supporting surfaces 55 of a spindle support 16 which can be applied engage and stabilize the position of the coupling sleeve 22 during roll change, is provided on the outer casing 53 of the coupling sleeve.

As can be seen from FIG. 5, each spindle support 16 comprises an actuator 57, which is preferably formed by a pressure medium cylinder, in order to bring supporting surfaces 55 of movable supporting claws 58 into contact with the coupling sleeve 22 for positionally fixing the latter during roll change. In this connection, these supporting surfaces 55 engage in the peripheral annular groove 54 of the coupling sleeve. Preferably two spindle supports 16 lying opposite one another and acting horizontally are fastened to the roll upright 5 in brackets 59. The displacing devices 17*a*, 17*b* for the locking element 23 are fastened to the displaceable part 60 of the spindle supports 16 in a support bracket 61 and are thus actuated synchronously with the supporting surfaces 55 of the spindle support 16. In addition, each displacing device is equipped with an application unit designed as a pressure medium cylinder 62 for displacing the locking element 23 between an operating position and a release position.

Alternatively, it is also possible according to an embodiment which is not illustrated to arrange the spindle support and the displacing device separately from one another on the roll upright and to actuate the spindle support and the displacing device independently of one another via separate actuators or synchronously via a synchronizing control.

The invention is not limited to the embodiment described. It is likewise within the scope of protection of the invention for the locking element to be inserted axially displaceably into a through-bore extending through the coupling sleeve. In this case, the locking element is configured at both its ends with connections for displacing devices which can be brought into engagement with the locking element at the same time and move the locking element in a synchronous movement from an operating position into a release position and back. Return of the locking element into the locked operating position, and therefore operational reliability, is thus reliably ensured even in the case of jamming of the locking element on account of soiling.

The invention is not limited to a two-high roll stand as described in the illustrative embodiment either but can be used generally in roll stands such as, for example, three-high, four-high, six-high and multi-roll stands irrespective of the cross section and material of the stock to be rolled.

The invention claimed is:

1. A rolling mill comprising a drive spindle which is arranged between a drive unit and a driven roll, a first spindle head on the spindle and connected detachably to the driven roll;

a coupling and decoupling device between the roll and the spindle head of the drive spindle, the coupling and decoupling device comprising a coupling sleeve extending along an axis of the driven roll, a coupling pin between the driven roll and the coupling sleeve, the coupling pin being inserted releasably into the coupling sleeve;

a locking element arranged displaceably transversely to the axis of rotation of the neck of the roll, and when inserted into the coupling sleeve and engages behind the coupling pin in an operating position of the locking element, and a locking element displacing device to which, the locking element is capable of being coupled and operable to displace the locking element transversely.

2. The rolling mill drive as claimed in claim 1, wherein the coupling pin comprises a foot plate having an end-side fastened to the neck of the roll and a coupling hook including at least one locking surface transverse to the axis of the coupling sleeve and projecting from the foot plate toward the locking element, a longitudinal groove including at least one counter-locking surface in the locking element and transverse to the axis of the coupling sleeve, the groove is positioned for guiding the coupling hook in and out of the coupling sleeve, the longitudinal groove having a coupling opening at one location along the groove, the locking element is movable into a release position at which the coupling opening in the locking element is aligned with the coupling hook enabling release of the coupling and decoupling device and the locking element is movable into an operating position at which the locking surface on the coupling hook lies opposite the counter-locking surface on the locking element enabling coupling of the coupling and decoupling device; and the displacing device is operable to move the coupling and decoupling device between the release and operating position.

3. The rolling mill drive as claimed in claim 2, wherein the coupling hook has a T-shape, and the locking element has a longitudinal groove transverse to the axis and of cooperating T-shape to receive the coupling hook.

4. The rolling mill drive as claimed in claim 1, wherein the driven roll has a first axis of rotation, the coupling pin has a second axis of rotation and the coupling sleeve of the spindle head has a third axis of rotation, the first, second and third axes are in alignment in relation to one another; and the longitudinal axis of the locking element is oriented transversely to the axes of rotation and intersects them.

5. The rolling mill drive as claimed in claim 1, wherein the locking element has a circular cylindrical outer contour; a circular cylindrical bore aligned radially in the coupling sleeve in which the outer contour of the locking element is inserted in a rotationally secured manner.

6. The rolling mill drive as claimed in claim 1, further comprising a preloaded tension spring between the locking element and a fixed stop on the coupling sleeve for fixing the operating position of the locking element.

7. The rolling mill drive as claimed in claim 1, further comprising a receiver for the displacing device at least on one side of the locking element.

8. The rolling mill drive as claimed in claim 1, wherein the displacing device comprises a pressure medium cylinder.

9. The rolling mill drive as claimed in claim 1, wherein the coupling sleeve has a peripheral annular groove, a spindle support having a supporting surface which lies opposite the annular groove, the spindle support is movable so that the supporting surface is movable into engagement with the annular groove for supporting the coupling sleeve;

the displacing device for the locking element is connected to the locking element for enabling synchronous movement of the displacing device and of the supporting surface of the spindle support.

10. The rolling mill drive as claimed in claim 9, wherein the displacing device is fastened rigidly to the displaceable spindle support.

11. The rolling mill drive as claimed in claim 9, wherein the displacing device and the supporting surface of the spindle support is connected to a control for synchronizing their movement sequence.

12. The rolling mill drive as claimed in claim 1, wherein the driven roll has a neck on the end of the driven roll, the first spindle head being detachably connected to the neck of the driven roll.

13. The rolling mill drive as claimed in claim 12, wherein the neck of the driven roll has a first axis of rotation, the coupling pin has a second axis of rotation and the coupling sleeve of the spindle head has a third axis of rotation, the first, second and third axes are in alignment in relation to one another; and the longitudinal axis of the locking element is oriented transversely to the axes of rotation and intersects them.

14. The rolling mill drive as claimed in claim 1, further comprising a spindle support outside the coupling sleeve and operable into engagement with the coupling sleeve for supporting the coupling sleeve; and the displacing device for the locking element being operable for enabling synchronous movement of the displacing device and the spindle support.

* * * * *